US006193091B1

(12) United States Patent
Olivetti

(10) Patent No.: US 6,193,091 B1
(45) Date of Patent: Feb. 27, 2001

(54) RECYCLING BIN

(75) Inventor: Salvatore Olivetti, Kleinberg (CA)

(73) Assignee: Wundale Holding S.A., Nassau (BS)

( * ) Notice: Subject to any disclaimer, the term of this patent is extended or adjusted under 35 U.S.C. 154(b) by 0 days.

(21) Appl. No.: 09/374,355

(22) Filed: Aug. 13, 1999

(51) Int. Cl.[7] ..... B65F 1/08
(52) U.S. Cl. ..... 220/23.88; 220/909; 220/23.86
(58) Field of Search ..... 220/909, 23.86, 220/23.83, 23.88; 232/43.2, 43.1

(56) References Cited

U.S. PATENT DOCUMENTS

| | | | | |
|---|---|---|---|---|
| 1,281,587 | * | 10/1918 | Kovachevich | 220/909 |
| 1,895,291 | * | 1/1933 | Meyer . | |
| 3,793,756 | * | 2/1974 | Kay et al. | 40/306 |
| 5,190,252 | * | 3/1993 | Schrager | 248/97 |
| 5,348,222 | * | 9/1994 | Patey | 232/43.2 |
| 5,377,907 | * | 1/1995 | Guard | 220/909 |
| 5,421,252 | * | 6/1995 | Reichel | 100/193 |

FOREIGN PATENT DOCUMENTS

| | | | | |
|---|---|---|---|---|
| 4006067A | * | 8/1991 | (DE) | 220/909 |

* cited by examiner

*Primary Examiner*—Stephen Castellano
(74) *Attorney, Agent, or Firm*—Eric Fincham

(57) ABSTRACT

A recycling bin designed to accept different materials, the bin having a base, a rear wall, a front wall, a pair of side walls and a cover, a plurality of containers being mounted in the recycling bin, locating means for separating each container from an adjacent container and maintaining each container in a desired position, flap means located within an upper portion of the front wall to provide access to an upper portion of each of the containers, and said back wall being hinged along a bottom edge to thereby provide access to the containers. The front and back walls are preferably arranged to accept information display panels such as advertising and which panels can only be accessed upon the unlocking of the recycling bin.

10 Claims, 4 Drawing Sheets

RECYCLING BIN

It is an object of the present invention to provide a recycling bin designed to accept different types of material for recycling.

BACKGROUND OF THE INVENTION

The collection of materials such as paper, glass and metal for recycling is becoming more common in our society. Thus, many communities have containers for the individual households into which various materials may be deposited and collected on a periodic basis. Generally, there is one type of container for glass products such as bottles and the like. Processed separately are various types of plastics. Similarly, many different grades of paper are recycled as are various metals such as employed in beverage containers.

The use of public recycling bins is also known in the art. Generally, these bins are not widely used as they tend to be unattractive units and have a certain cost associated therewith for the manufacture thereof.

SUMMARY OF THE INVENTION

It is an object of the present invention to provide a recycling bin which is economical to manufacture and which can accept information display panels such as may be used in advertising.

According to one aspect of the present invention, there is provided a recycling bin comprising a base, at least one wall extending upwardly from the base to define an enclosed bin, and a cover for the enclosed bin; a plurality of containers mounted in the recycling bin; locating means for separating each container from adjacent containers and maintaining each container in a desired position; flap means located within an upper portion of the at least one wall to provide access to an upper portion of the containers; and a hinged wall portion within the at least one wall to thereby provide access to the containers.

Preferably, the container is formed to have a rectangular configuration with a front wall, a rear wall and a pair of end walls, with the flap means being located within an upper portion of the front wall.

A preferred construction is one wherein the back wall is hinged at a bottom edge thereof to permit opening and to thereby provide access to the containers for emptying of the same.

In order to provide a revenue source, the recycling bin preferably includes display frames designed to receive at least one information display. The display frames may be associated with any of the walls with a preferred embodiment incorporating display frames with at least one of the front or back walls. The display frames are arranged such that access thereto is prohibited without the rear wall being opened.

The recycling bin also preferably includes locating means for locating and maintaining the containers in a desired position.

BRIEF DESCRIPTION OF THE DRAWINGS

Having thus generally described the invention, reference will be made to the accompanying drawings illustrating embodiments thereof, in which.

DESCRIPTION OF THE PREFERRED EMBODIMENTS

Figure 1:
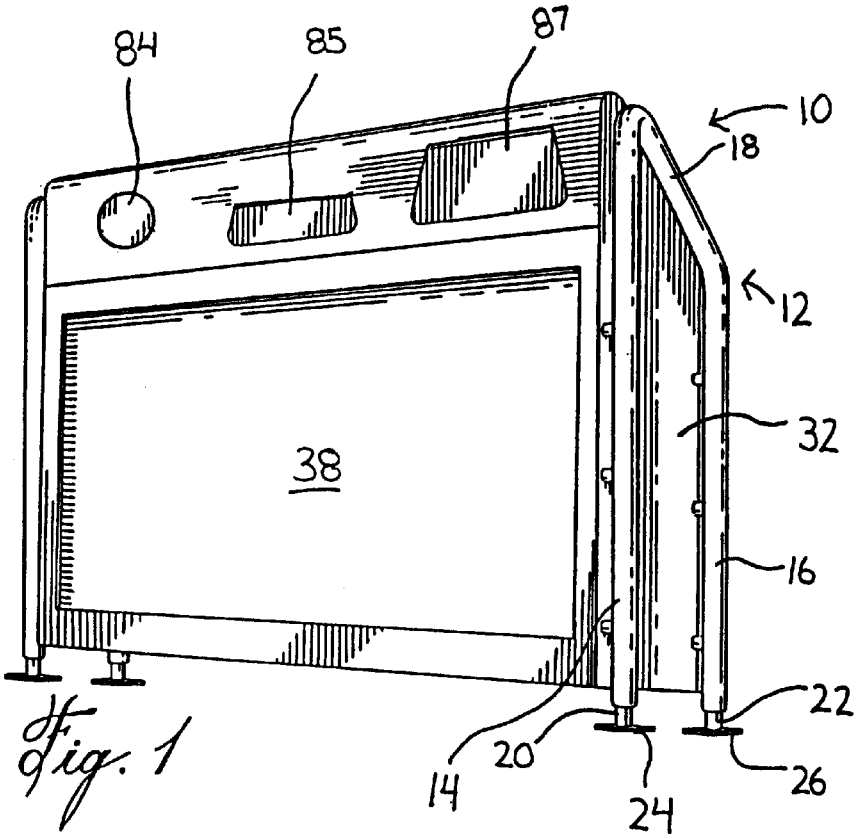
FIG. 1. is a front perspective view of a recycling bin according to one embodiment of the present invention.
Figure 2:
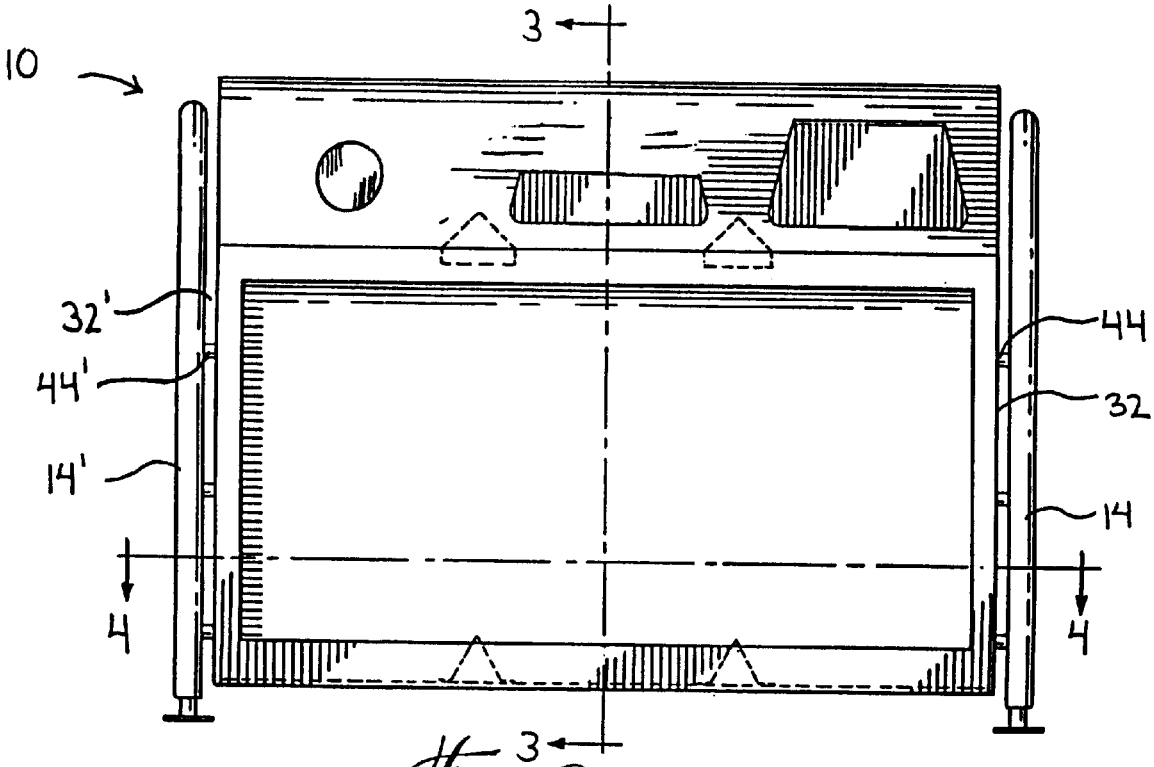
FIG. 2 is a front elevational view thereof.

Referring to the drawings in greater detail and by reference characters thereto, there is illustrated a recycling bin generally designated by reference numeral 10.

Recycling bin 10 has a pair of U-shaped side frames generally designated by reference numerals 12 and 12'. In this respect, reference numerals with a prime are utilized for similar components as the recycling bin is substantially symmetrical about a vertical axis extending from the front to the rear of the recycling bin.

U-shaped side frame 12 includes a front vertical frame member 14, a rear vertical frame member 16, and a top horizontal frame member 18 which extends between front vertical frame member 14 and rear vertical frame member 16 and merges arcuately therewith.

Front vertical frame member 14 includes a front leg extension 20 while rear vertical frame member 16 similarly has a rear leg extension 22. Preferably, both front leg extension 20 and rear leg extension 22 are screw threadably engageable with their respective vertical frame members so as to provide adjustability thereto. Each of front leg extension 20 and rear leg extension 22 have pads 24 and 26 respectively associated therewith.

Recycling bin 10 is of a generally rectangular form and includes a back wall panel 30, a first end panel 32, a second end panel 32', and a front wall panel 38. As may be seen in FIG. 3, front wall panel 38 extends upwardly a greater distance than back wall panel 30 and extending between front wall panel 38 and back wall panel 30 is a sloping top wall panel 36. A bottom wall or base 40 extends between the panels.

Both U-shaped side frames 12 and 12' are secured to respective end panels 32, 32' by means of attachment means 44.

Figure 3:
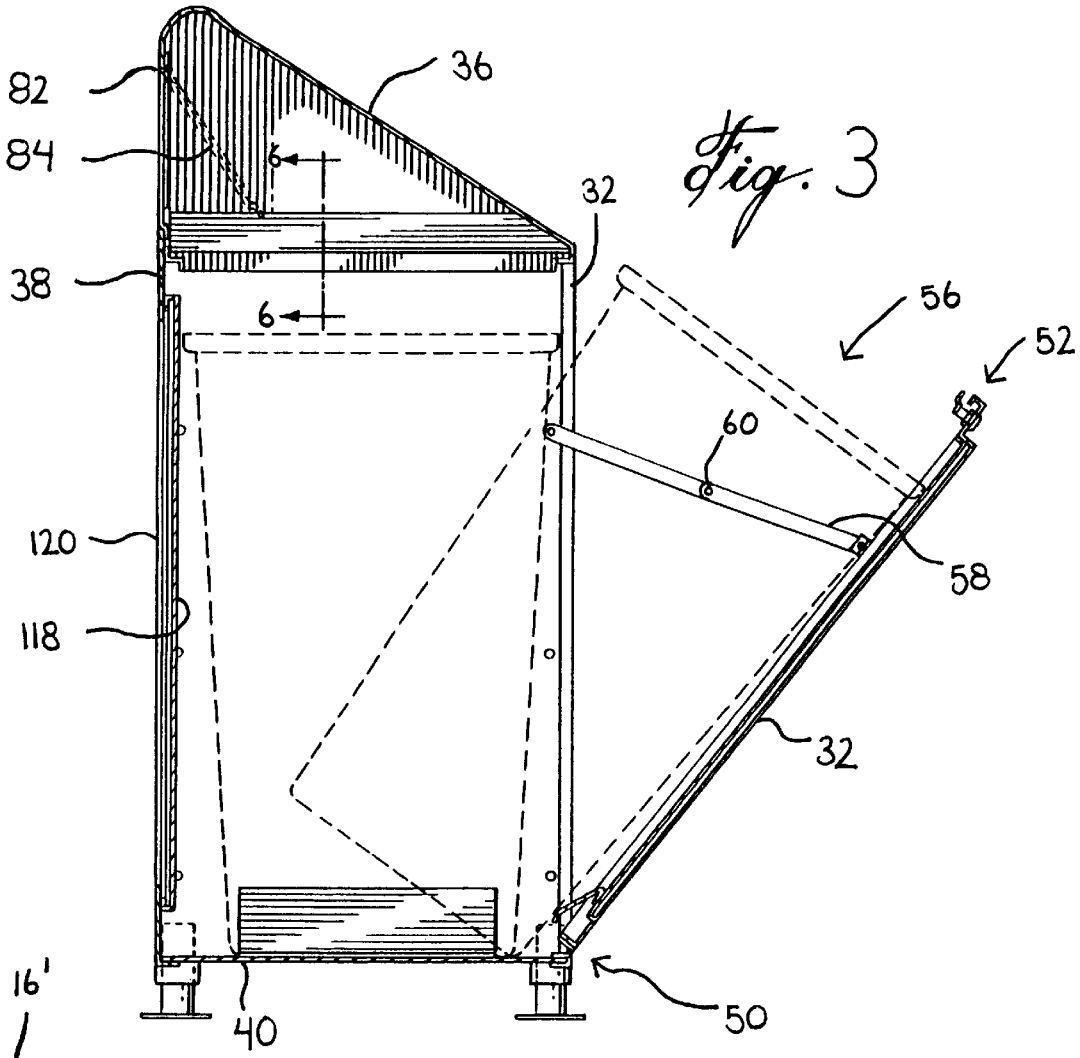
FIG. 3 is a side sectional view taken through the line 3—3 of FIG. 2.

Back wall panel 30, as may be best seen in FIG. 3, is hingedly connected to base 40 by means of a hinge member 50. At its upper end, back wall panel 30 includes latching means 52.

Mounted interiorly of recycling bin 10 are a plurality of containers 56, each having a cover member 58. Cover 58, as may not be shown best seen in FIG. 3, is preferably hingedly connected to the side walls of the container at pivot point 60. Containers 56 have side walls which taper inwardly to thereby have a slightly inverted frustraconical configuration.

Figure 4:
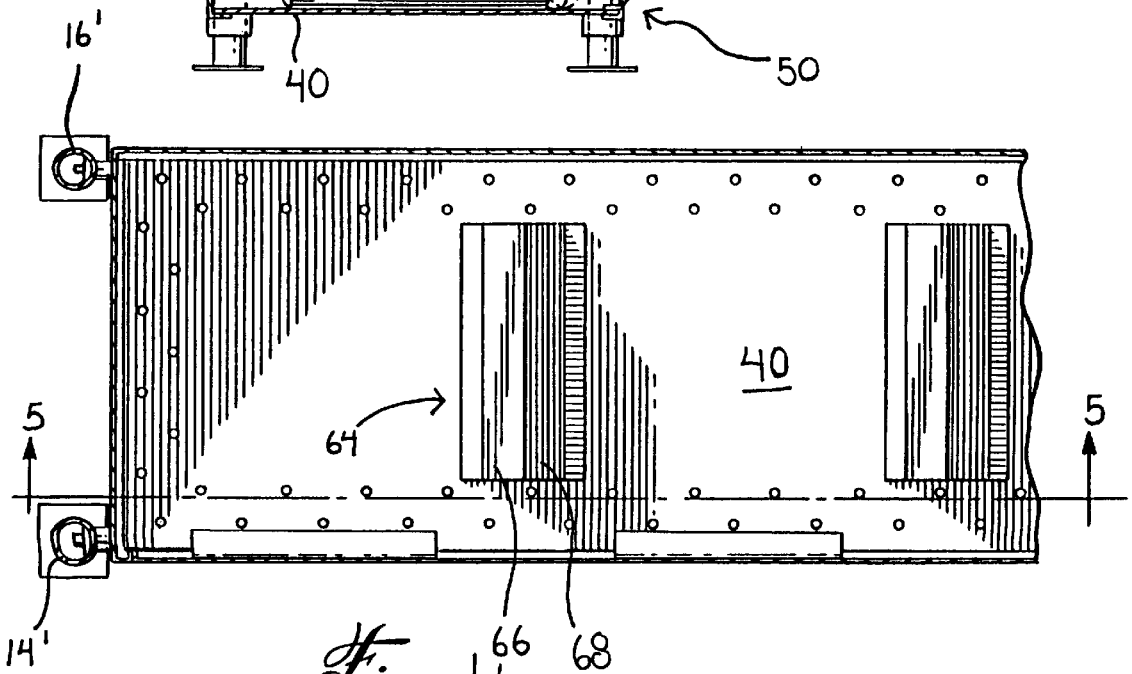
FIG. 4 is a sectional view taken along the line 4—4 of FIG. 2.
Figure 5:
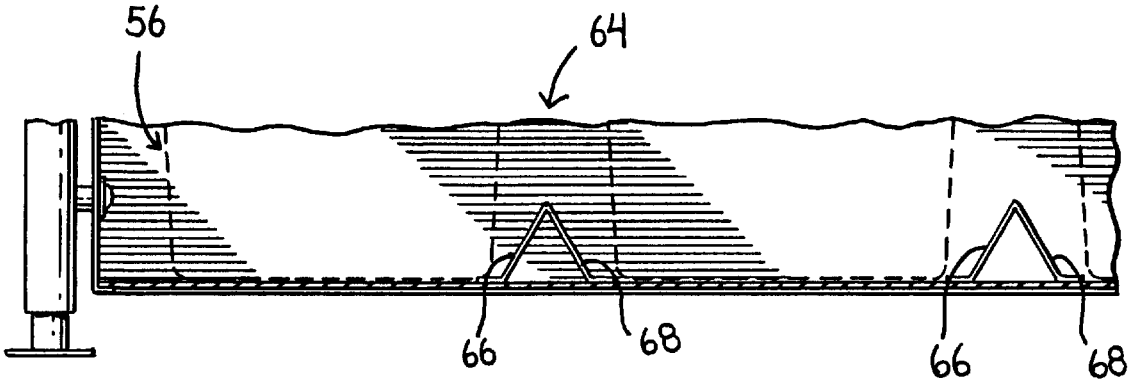
FIG. 5 is a sectional view taken along the line 5—5 of FIG. 4.
Figure 6:
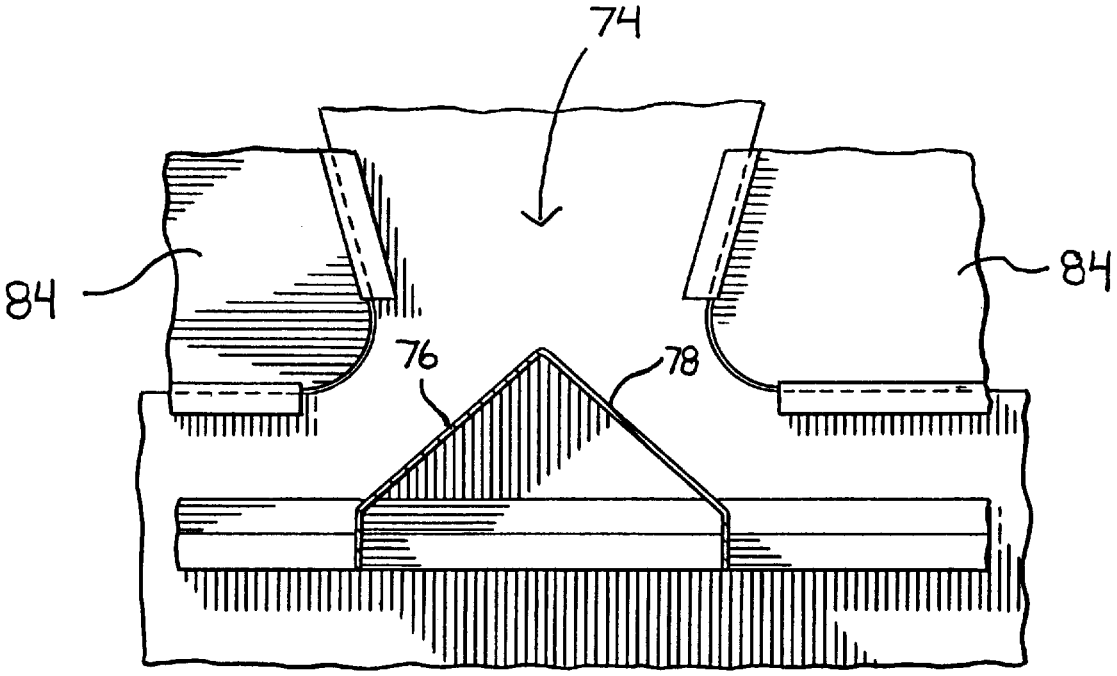
FIG. 6 is a sectional view taken along the line 6—6 of FIG. 3.

Mounted on base 40, as may be best seen in FIGS. 4 and 5, are a plurality of lower dividers 64, each lower divider 64 having a V-shaped configuration defined by a first lower divider wall 66 and a second lower divider wall 68.

Extending horizontally within recycling bin 10, from an area adjacent the top of back wall panel 30 to front wall panel 38 are upper dividers having a generally inverted V-shaped configuration defined by a first upper divider wall 76 and a second upper divider wall 78.

Mounted in the upper portion of front wall panel 38 are a plurality of flaps 84, 85 and 87 each connected by means of a hinge 82 to thereby permit access to individual containers 56 to deposit material therein. Flap 84 is circular to indicate that recyclable containers are to be deposited therein, while flap 85 is designed to receive recycled paper and flap 87 is designed to receive garbage.

Figure 8:
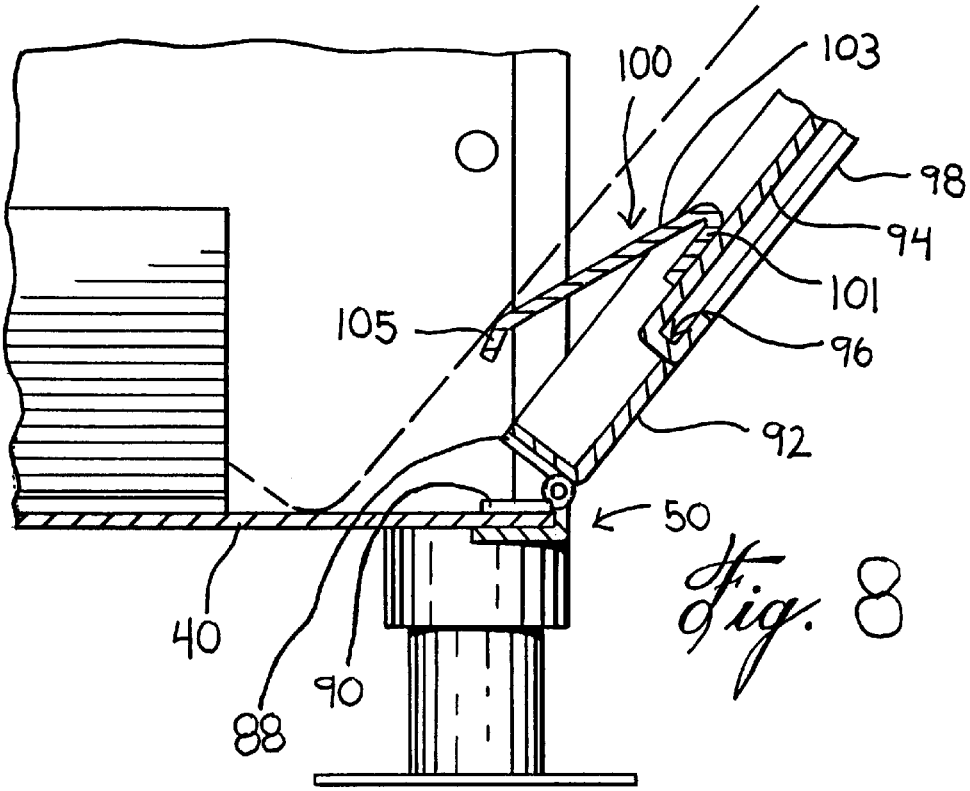
FIG. 8 is a detailed sectional view showing the hinging mechanism for opening the back wall of the recycling bin.

As aforementioned, back wall panel 30 is hingedly connected to base 40 as is most clearly seen in FIG. 8. Hinge 50 includes a pair of hinge plates 88 and 90, hinge plate 90 being connected to base 40 and hinge plate 88 being connected to an L-shaped bracket 92. Bracket 92 in turn is connected to a display panel frame 94. Display panel frame 94 has a U-shaped bottom portion as designated by reference numeral 96 to receive an information panel therein. A transparent panel 98 is provided as the facing panel.

As also may be seen in FIG. 8, there is provided a container positioning member generally designated by reference numeral 100. Container positioning member 100 has a first portion 101 connected to display panel frame 94 with a second portion 103 extending rearwardly of display panel frame 94 and forming a somewhat V-shaped configuration with respect to first portion 101. Second portion 103 terminates in a slightly inwardly tapered flange 105. Container positioning member 100 functions to maintain containers 56 in the desired position with respect to back wall panel 30 when the same is opened. Container positioning member 100 prevents the misalignment of the containers and possible subsequent jamming thereof.

It will also be appreciated that second portion 103 could be bent inwardly or outwardly for different size containers.

Figure 7:
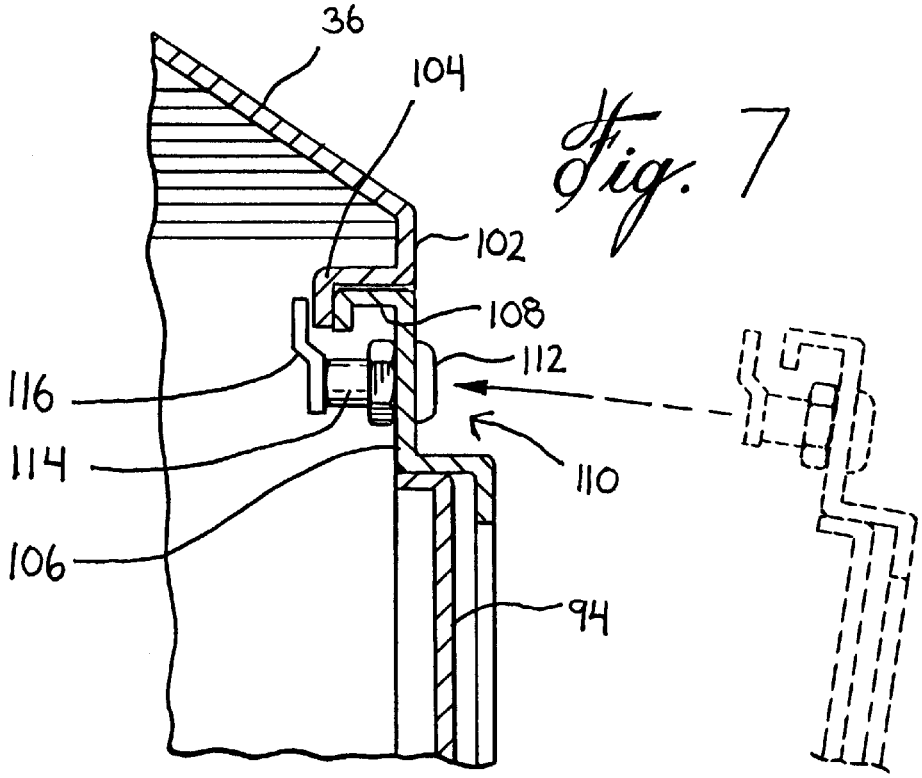
FIG. 7 is a detailed sectional view showing the latching mechanism for the bin.

As described above, back panel 30 also includes latch means 52, which latch means 52 are shown in detail in FIG. 7. Thus, as may be seen, top wall 36 has a downwardly extending lip portion 102 from which extends inwardly an L-shaped portion 104. A lock support plate 106 is secured to an upper portion of display panel frame 94 and includes a U-shaped portion designed to abut inwardly extending L-shaped portion 104. In turn, there is provided a locking mechanism generally designated by reference numeral 110 which includes a locking head 112, a shaft 114 extending rearwardly thereof and a flange 116 which, when in a locked position, engages the rear side of L-shaped portion 104.

In addition to the information display panel in the rear wall, the front wall panel 38 may likewise include information display means. As may be seen in FIG. 3, there is thus provided a front display panel frame 118 similar to display panel frame 94 and having a transparent cover 120. Access to the information display panel 118 is only from interiorly of the container while the display panel associated with the rear wall can likewise only be accessed when the rear wall is hingedly opened.

It will be understood that the above described embodiments are for purposes of illustration only and that changes and modifications may be made thereto without departing from the spirit and scope of the invention.

I claim:

1. A recycling bin comprising a base, a front wall, a rear wall and a pair of side walls, said walls extending upwardly from said base to define an enclosed bin, and a cover for said enclosed bin;

a plurality of containers mounted in said recycling bin;

divider means for separating each container from adjacent containers;

individual flaps located within an upper portion of said front wall to provide access to an upper portion of each of said containers, each of said flaps having a different configuration to identify different material to be placed therein; and a hinged wall portion within said rear wall to thereby provide access to said containers.

2. The recycling bin of claim 1 wherein said divider means for separating said containers comprise triangularly shaped members located on said base.

3. The recycling bin of claim 1 wherein said rear wall is hinged at a bottom edge thereof to permit opening said hinged wall portion to thereby provide access to said containers.

4. The recycling bin of claim 3 further including a display frame designed to receive at least one information display, said display frame being mounted on said rear hinged wall, said display frame including means permitting access to receive said information display, said means permitting access being non-accessible when said rear wall is in a closed position.

5. The recycling bin of claim 3 wherein said hinged rear wall includes means for locating said containers in a desired position.

6. The recycling bin of claim 3 wherein said rear wall includes locking means for locking said rear wall in a closed position.

7. The recycling bin of claim 3 wherein each of said containers has inwardly and downwardly tapering side walls to thereby have a bottom portion which is sized to be smaller than a top portion thereof, and positioning members located on said rear wall to maintain said containers in a desired position when said rear wall is opened.

8. The recycling bin of claim 1 wherein said front wall includes a display frame designed to receive at least one information display, and access means to place an information display in said display frame, said access means being located interiorly of said bin to prevent unauthorized access to said information display.

9. A recycling bin comprising a base, a front wall, a rear wall, and a pair of side walls, said side walls extending upwardly from said base to define an enclosed bin, and a cover for said enclosed bin;

a plurality of containers mounted in said recycling bin;

divider means for separating each container from adjacent containers, individual flaps located within an upper portion of said front wall to provide access to an upper portion of each of said containers, a hinged wall portion within said rear wall to thereby provide access to said containers; and container positioning members mounted on said rear wall.

10. Recycling bin of claim 9 wherein said rear wall is hinged to the bottom edge thereof to permit opening said hinged wall portion to thereby provide access to said containers.

* * * * *